US006585668B2

(12) United States Patent
Nissim

(10) Patent No.: US 6,585,668 B2
(45) Date of Patent: Jul. 1, 2003

(54) HUMAN TOUCH MASSAGER

(76) Inventor: Elias Nissim, 85 Pinchas Rottenberg Street, Ramat-Gan 52275 (IL)

( * ) Notice: Subject to any disclaimer, the term of this patent is extended or adjusted under 35 U.S.C. 154(b) by 222 days.

(21) Appl. No.: 09/736,954

(22) Filed: Dec. 14, 2000

(65) Prior Publication Data

US 2001/0014781 A1 Aug. 16, 2001

(30) Foreign Application Priority Data

Dec. 16, 1999 (IL) ..... 133551

(51) Int. Cl.[7] ..... A61H 7/00

(52) U.S. Cl. ..... 601/84; 601/98; 601/103; 601/133; 601/134

(58) Field of Search ..... 601/133–135, 601/137, 117, 107, 108, 111, 98, 90, 86, 46, 41, 24, 23

(56) References Cited

U.S. PATENT DOCUMENTS 4,249,534 A * 2/1981 Muldrow, Jr. ..... 601/133
4,984,568 A * 1/1991 Persaud ..... 601/122
5,083,552 A 1/1992 Lipowitz
5,195,532 A * 3/1993 Schumacher et al. ..... 600/552
5,876,325 A * 3/1999 Mizuno et al. ..... 600/102
6,190,339 B1 * 2/2001 Imazaike et al. ..... 601/133
6,200,282 B1 * 3/2001 Furuie et al. ..... 601/101
6,267,737 B1 * 7/2001 Meilus ..... 601/108

OTHER PUBLICATIONS

Internet Archive @ archive.org search results showing dates of www.cs.columbia.edu/robotics/projects/hands/haptic–sensing.html.*
Internet Archive @ archive.org search results showing dates of www.cs.columbia.edu/robotics/projects/hands/manimpulation.html.*
"A Light–Weight Anthropomorphic Hand"; cs.yale.edu/AI/VisionRobotics/YaleHand; Nov. 1999.
"Haptic Sensing"; cs.columbia.edu/robotics/projects/hands/haptic–sensing; Nov. 1999.
Homepage of Genex Technologies Inc.; genextech.com/prodo3.
Homepage of 3DV Systems Ltd.; 3dvsystems.com/zcam.fs.

* cited by examiner

*Primary Examiner*—Danton D. DeMille
(74) *Attorney, Agent, or Firm*—Fenster & Company

(57) ABSTRACT

A massage machine for massaging a person's body comprising: a robot hand comprising a first digit and at least one second digit that is opposable to the first digit, wherein the first digit and at least one second digit are moveable towards and away from each other; and at least one digit actuator for moving the first digit towards and away from the at least one second digit to massage a region of the person's body to which at least one of the digits is pressed.

31 Claims, 8 Drawing Sheets

HUMAN TOUCH MASSAGER

FIELD OF THE INVENTION

The invention relates to massage machines and in particular to computer controlled massage machines.

BACKGROUND OF THE INVENTION

A plethora of massage devices exist in the market to implement various massage methods and techniques. The devices range from simple objects having different and varied advantageous "massage shapes", which are pressed and moved over the body by hand, to computerized massage machines.

A computerized massage machine is described in U.S. Pat. No. 5,083,552 to Lipowitz. The massage machine comprises a gantry to which is mounted an extension, hereinafter referred to as a "massage arm" having a massage head at an end thereof. The massage head comprises a component, hereinafter referred to as a "massage applicator", which is a part of the massage machine that touches and presses on the body of a person to massage regions of the person's body. To perform a massage on a person, the person lies on an appropriate table and a computer controls motion of the gantry and massage arm to move and position the massage head so that the applicator presses on different regions of the person's body with desired pressure. The massage head comprises a device for measuring the pressure with which the applicator presses on the person's body and sensors that sense when the massage head is located near an edge of the body. Output signals from the pressure-sensing device are received by the computer and used to control the pressure with which the applicator presses on the person's body. Output signals from the edge-sensors are input to the computer and are used to control motion of the massage head so that the massage head does not move beyond the boundaries of the body In spite of the availability of various massage devices of lesser or greater technical sophistication, massages that these devices can provide are not as satisfactory or as pleasing as massages provided by a person.

SUMMARY OF THE INVENTION

An aspect of some preferred embodiments of the present invention relates to providing a massage machine that gives a massage that mimics a massage given by a person.

A massage machine in accordance with a preferred embodiment of the present invention, comprises a massage head having at least one massage applicator, hereinafter referred to as a "robot massage hand", that mimics a massage motion of the human hand. The robot massage hand preferably comprises at least one protuberance preferably resembling a finger and at least one protuberance preferably resembling an opposable thumb that opposes the at least one finger. The robot massage hand comprises apparatus for moving the opposable thumb and the at least one finger towards and away from each other with motions similar to motions with which the thumb and a finger of the human hand are moved towards and away from each other. The massage machine comprises apparatus for positioning the robot massage hand at a region of a person's body to be massaged with the thumb and at least one finger spaced apart and pressing on the region with desired pressures. The thumb and finger are then repeatedly brought towards and away from each other to squeeze and knead the region with a desired pressure in much the way that a human masseuse would squeeze and knead the region. The squeezing and kneading is repeated at different locations of the person's body to give the person a massage. Preferably, a computer controls the apparatus that moves and positions the robot massage hand and its digits (i.e. the thumb and at least one finger).

In some preferred embodiments of the present invention the at least one finger comprises a plurality of fingers. In some preferred embodiments of the present invention the fingers of the plurality of fingers move together as a single unit towards and away from the thumb. In some preferred embodiments of the present invention, the thumb and each of the plurality of fingers are moveable independently of each other to mimic squeezing and pressure motions that a masseuse uses to massage a person's body. In some preferred embodiments of the present invention the robot massage hand is an anthropomorphic hand.

Preferably, the computer that controls the motion of the robot massage hand comprises a memory in which data can be stored that define motion templates for controlling motion of the robot massage hand and its digits. Different motion templates are useable to control the robot massage hand and its digits so that motions of the hand and digits mimic different massage motions of a human hand.

An aspect of some preferred embodiments of the present invention relates to providing a massage machine having a massage applicator that is controllable to caress and/or stroke the body of a person using the massage machine.

Massages are often given for therapeutic and analgesic purposes, for example, to reduce muscle spasms, to unknot knotted muscles and restore proper muscle motion, to increase blood flow and/or reduce pain in massaged body regions. Massages, hereinafter referred to as caressing massages, are also given to relax and pleasure a person and increase the person's feeling of well being. Some of the motions used by a masseuse to relax and pleasure a person are not only the familiar "kneading" and striking motions of a massage but are also soothing caressing and stroking motions. The caressing and stroking motions are generally slower than the kneading and striking motions and are usually applied to the body with substantially less force than the kneading and striking motions. In accordance with preferred embodiments of the present invention, a machine massager comprises at least one applicator controllable to apply caressing and/or stroking motions to the body of a person using the machine massager. Preferably, the applicator that performs the caressing and stroking motions is a robot massage hand that is controlled by a computer responsive to a "caressing" template. In some preferred embodiments of the present invention the computer controls the robot massage hand responsive to a caressing template to move a finger or the thumb of the robot massage hand lightly over the skin of the person to scratch, tingle or tickle the skin. In some preferred embodiments of the present invention, the applicator that performs the caressing and/or stroking motions is a feather or feather like.

An aspect of some preferred embodiments of the present invention relates to providing a massage machine comprising a 3D-vision system.

The 3D-vision system provides a 3D map of the position and features of a person's body being massaged by the massage machine. The computer positions the robot massage hand at different locations of the person's body and controls motion of massage hand's digits responsive to the 3D map and to a motion template stored in the memory.

An aspect of some preferred embodiments of the present invention relates to providing a massage machine that has at least one massage head comprising a plurality of massage applicators. Preferably, the massage machine comprises a computer that controls motion of each of the plurality of applicators.

Preferably, at least one of the plurality of massage applicators is different from the other applicators. Preferably, at least one massage applicator is a robot massage hand. Preferably, during a massage, the computer can control the massage applicators so as to change an applicator that is being used to massage a person to a different one of the applicators of the plurality of applicators comprised in the at least one massage head.

There is therefore provided in accordance with a preferred embodiment of the present invention a massage machine for massaging a person's body comprising: at least one robot hand having a first digit and at least one second digit that is opposable to the first digit, wherein the first digit and at least one second digit are moveable towards and away from each other; and at least one digit actuator for moving the first digit towards and away from the at least one second digit to massage a region of the person's body to which at least one of the digits is pressed.

Preferably, the robot hand is an anthropomorphic robot hand. Alternatively or additionally the first digit functions in a manner similar to the functioning of the thumb and the at least one second digit functions in a manner similar to the functioning of a finger.

Alternatively or additionally the massage machine comprises a computer that controls the at least one digit actuator. Preferably, the computer is programmable to control the at least one digit actuator to move the first digit and at least one second digit toward each other with a desired force.

Preferably the massage machine comprises at least one sensor that generates digit force signals responsive to a force with which the first digit and at least one second digit move toward each other. Preferably, the computer receives the digit force signals and controls the force with which the first digit and at least one second digit move toward each other responsive thereto.

Alternatively or additionally the massage machine preferably comprises a support structure to which the robot hand is mounted. Preferably, the at least one robot hand is mounted to the support structure so that the at least one robot hand is moveable to massage different desired regions of the person's body.

Preferably, the massage machine comprises at least one motion actuator operative to move the at least one robot hand from region to region of the body. Preferably, the computer controls the at least one motion actuator.

Preferably, the computer is programmable to control the at least one motion actuator to move the at least one robot hand in a desired direction with a desired force. The massage machine preferably comprises at least one sensor that generates motion force signals responsive to a force with which the at least one robot hand moves. Preferably, the computer receives the motion force signals and controls the force with which the at least one robot hand moves responsive thereto.

Preferably, the massage machine comprises at least one sensor that generates digit force signals responsive to a force with which the first digit and at least one second digit move toward each other which digit force signals are received by the computer and the computer controls the force with which the at least one robot hand moves responsive to the digit force signals.

In some preferred embodiments of the present invention the at least one motion actuator is operative to move the at least one robot hand along any of three orthogonal directions.

In some preferred embodiments of the present invention the at least one robot hand is rotatable about a first axis substantially parallel to a general direction along which the first digit and at least one second digit extend when the first digit and at least one second digit are moved by the at least one digit actuator to be maximally close to each other.

Preferably, the massage machine comprises at least one motion actuator operative to rotate the at least one robot hand about the first axis. Preferably, the computer controls the at least one motion actuator operative to rotate the at least one robot hand about the first axis.

In some preferred embodiments of the present invention the at least one robot hand is rotatable about a second axis substantially perpendicular to a general direction along which the first digit and at least one second digit extend when the first digit and at least one second digit are moved by the at least one digit actuator to be maximally close to each other.

Preferably, the massage machine comprises at least one motion actuator operative to rotate the at least one robot hand about the second axis. Preferably, the computer controls the at least one motion actuator operative to rotate the at least one robot hand about the second axis.

In some preferred embodiments of the present invention the at least one robot hand comprises at least one haptic sensor that generates signals responsive to the at least one robot hand touching the person's body. Preferably, the computer receives the signals generated by the at least one haptic sensor and controls at least one actuator of the massage machine responsive thereto.

In some preferred embodiments of the present invention the massage machine comprises a 3D vision system that generates data responsive to features of the person's body and positions of the features. Preferably, the computer receives data from the 3D vision system and controls at least one actuator of the massage machine responsive to the data.

In some preferred embodiments of the present invention the computer is programmable to control at least one of the at least one digit actuators and the at least one motion actuator of a robot hand of the at least one robot hand to massage a region of the person's body with at least one type of massage motion that mimics a massage motion performed by a person.

There is further provided, in accordance with a preferred embodiment of the present invention, a massage machine for massaging a person's body comprising: at least one robot hand comprising a first digit and at least one second digit wherein the first digit is opposable to each of the at least one second digit, which first and at least one second digit are moveable to simulate at least one massage motion of the human hand; at least one digit actuator that moves the first and at least one second digit; a support structure to which the at least one robot hand is mounted moveable to position and orient the at least one robot hand to massage different regions of the person's body; at least one motion actuator that moves the support structure; a 3D vision system that generates data responsive to features of the person's body and positions of the features; and a computer that receives the data and controls at least one of the at least one digit actuator and at least one motion actuator of a robot hand of the at least one robot hand responsive to the 3D vision data to massage at least one region of the person's body with at least one type massage motion that mimics a massage motion performed by a person.

In some preferred embodiments of the present invention, the at least one type of massage motion comprises a squeezing motion in which the first digit and at least one second digit of the robot hand move towards each other to squeeze the region of the person's body with a desired force.

In some preferred embodiments of the present invention, the at least one type of massage motion comprises a pressing motion in which at least one digit of the robot hand presses a region of the person's body with a desired force of desired magnitude.

In some preferred embodiments of the present invention, the at least one type of massage motion comprises a kneading motion in which the first digit and at least one second digit of the robot hand press the region of the person's body with a first desired force and squeeze the region with a second desired force while the robot hand executes a circular motion that applies a desired torque to the region.

In some preferred embodiments of the present invention, the at least one type of massage motion comprises a striking motion in which at least one digit of robot hand strikes the region with a desired force.

In some preferred embodiments of the present invention, the at least one type of massage motion comprises a caressing motion in which at least one digit of the robot hand presses the region lightly and moves along the region with a stroking motion.

In some preferred embodiments of the present invention, the at least one digit of the at least one robot hand comprises a relatively sharp protuberance. Preferably, the at least one massage motion comprises a scratching motion in which the relatively sharp protuberance of a digit of the robot hand that comprises a sharp protuberance presses against the region and the protuberance moves to scratch the region.

In some preferred embodiments of the present invention, the computer is programmable to control actuators of the massage machine to massage the person's body responsive to a desired program.

Preferably, the program defines a sequence of desired regions of the person's body to be massaged. Alternatively or additionally, the program preferably defines desired massage motions to be applied to each of the desired massage regions of the person's body. Preferably, the program defines the duration of each of the desired massage motions. Alternatively or additionally, the program is preferably modifiable while the computer is executing the program.

In some preferred embodiments of the present invention, the massage machine comprises at least one massage applicator other than the at least one robot hand mounted to the support structure

BRIEF DESCRIPTION OF FIGURES

The invention will be more clearly understood from the following description of preferred embodiments thereof read with reference to figures attached hereto. In the figures, identical structures, elements or parts that appear in more than one figure are generally labeled with the same numeral in all the figures in which they appear. Dimensions of components and features shown in the figures are chosen for convenience and clarity of presentation and are not necessarily shown to scale. The figures are listed below.

DETAILED DESCRIPTION OF PREFERRED EMBODIMENTS

Figure 1A:
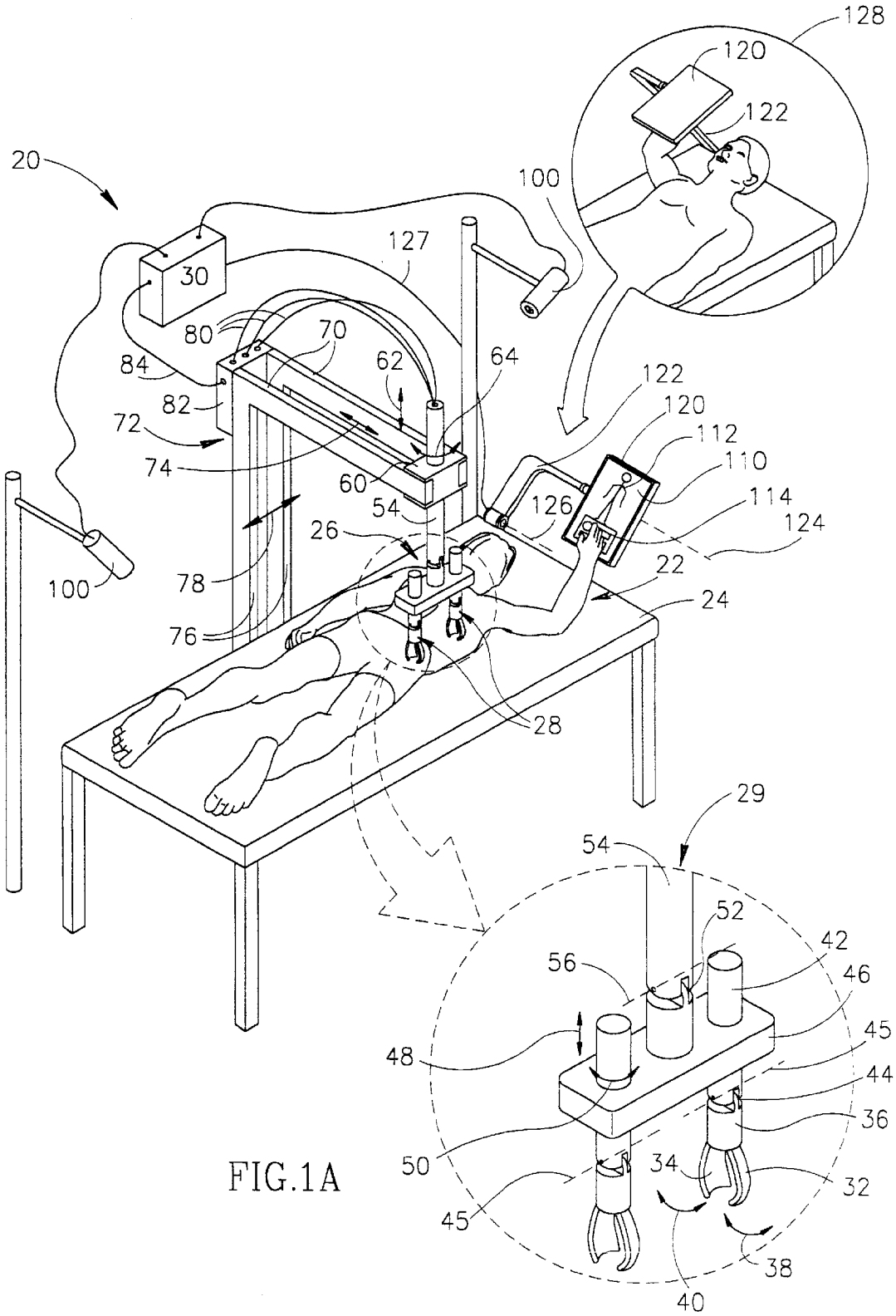
FIG. 1A schematically shows a massage machine comprising two robot massage hands massaging a person, in accordance with a preferred embodiment of the present invention.

FIG. 1A shows a massage machine 20 massaging a person 22 lying on a massage table 24, in accordance with a preferred embodiment of the present invention. Massage machine 20 preferably comprises a massage head 26 comprising two robot massage hands 28 and a computer 30.

For clarity and ease of presentation, details of massage head 26 and robot massage hands 28 are shown enlarged in an inset 29. To reduce clutter, numerals identifying components and features of robot massage hands 28 are shown for only one or the other of massage hands 28.

Each robot massage hand 28 preferably comprises an opposable thumb 32 and a broad "finger" 34 having a shape and dimensions of four fingers of a human hand held together to form an extension of the palm of the hand. Thumb 32 and finger 34 are preferably mounted to a "palm" brace 36 and are rotatable towards and away from each other in directions indicated by double arrowhead arcs 38 and 40 respectively. Palm brace 36 is preferably connected to a "wrist" tube 42 by an elbow joint 44 that enables palm brace 36 to rotate about an axis 45.

Thumb 32 and finger 34 of robot massage hands 28 shown in FIG. 1A are preferably jointless and robot massage hands 28 are preferably relatively simple. In some preferred embodiments of the present invention, robot massage hands 28 comprise more than two digits. In some preferred embodiments of the present invention the fingers and a thumb comprised in a robot hand are articulated and are capable of executing substantially more complicated motion than the relatively simple motions indicated by arrowhead arcs 38 and 40.

Figure 1B:
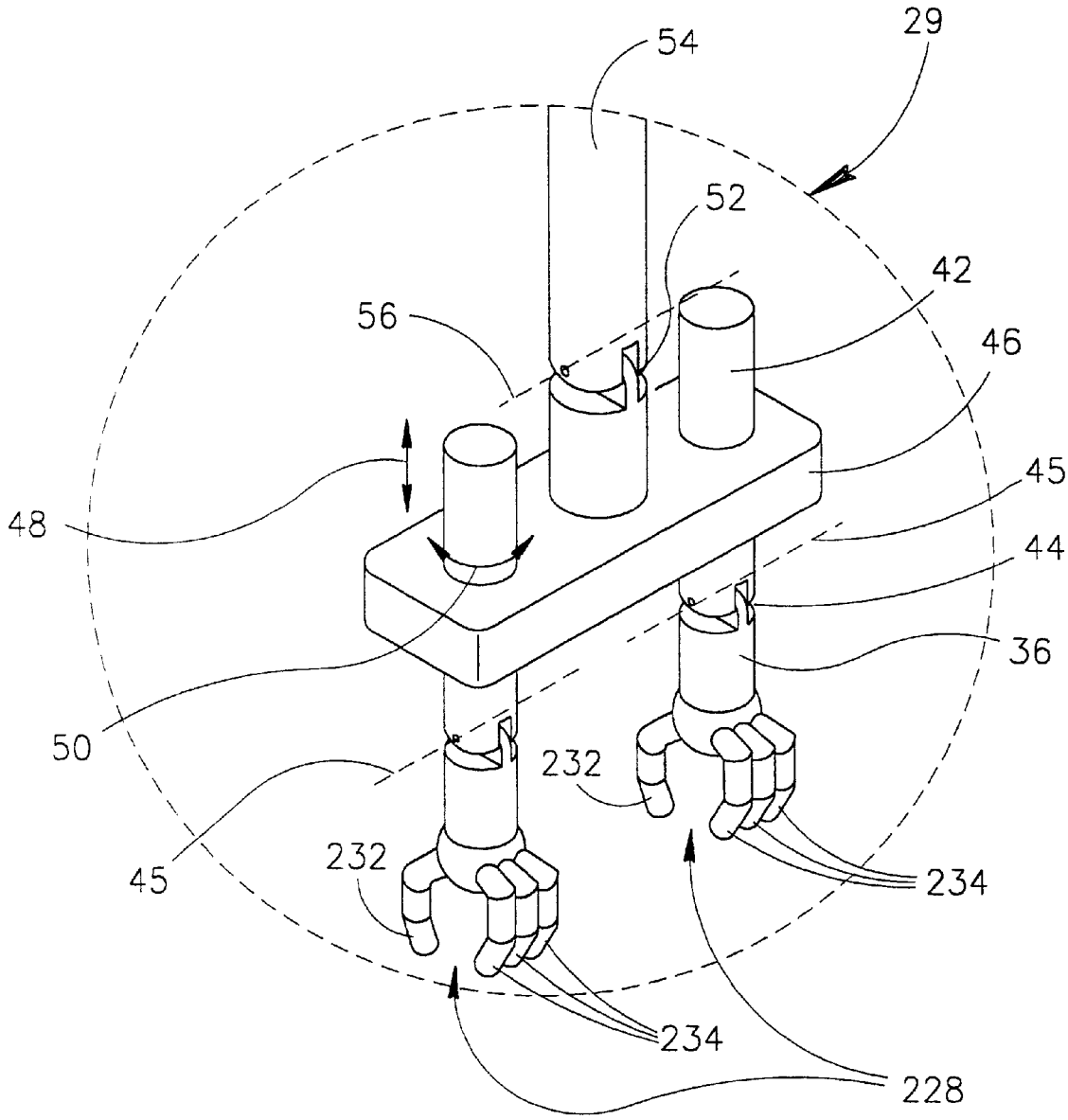
FIG. 1B schematically shows robot massage hands having articulated thumbs and articulated fingers, in accordance with a preferred embodiment of the present invention.

FIG. 1B shows massage head 26 comprising robot massage hands 228 that are distinctly anthropomorphic. Each robot massage hand comprises an articulated thumb 232 and three articulated fingers 234, in accordance with a preferred embodiment of the present invention. Robot massage hands 228 can perform finer and more varies motions than robot massage hands 28. For example, robot massage hands 228 can perform pinching and grasping motions substantially more similar to pinching and grasping motions performed by the human hand than pinching and grasping motions performed by robot massage hands 28.

Technology and methods for producing robot hands similar to and substantially more complicated than robot massage hand 28 are well known in the art. For example, a robot hand having articulated fingers that are operated via cables connected to motors is described at URL address "cs.yale.edu/AI/VisionRobotics/YaleHand", on a page entitled "A Lightweight Anthropomorphic Hand" in November 1999, the disclosure of which is incorporated herein by referance. A robotic hand that comprises apparatus that provides the robotic hand with a sense of touch is described at URL address "cs.columbia.edu/robotics/projects/hands/haptic-sensing" on a page entitled "Haptic Sensing" in November 1999, the disclosure of which is incorporated herein by reference.

Massage head 26 preferably comprises a platform plate 46 to which wrist tube 42 of each robot massage hand 28 is mounted. Wrist tube 42 of each robot massage hand 28 is preferably mounted to platform plate 46, using methods known in the art, by bearings (not shown) that enable the wrist tube to move in directions indicated by double arrowhead lines 48 perpendicular to the plane of platform plate 46. The bearings also, preferably, enable wrist tube 42 to rotate back and forth in directions indicated by double arrowhead arcs 50. Platform plate 46 is preferably connected by an elbow joint 52 to a massage arm 54 that enables rotational motion of platform plate 46 about an axis 56. The motion and position of wrist tube 42 in directions indicated by arrowhead line 48 and arrowhead arc 50 are controlled by actuators (not shown), such as motors, responsive to signals received from computer 30, using any convenient method known in the art.

Massage arm 54 preferably passes through a hole in a trolley 60 and is mounted to bearings (not shown) comprised inside trolley 60. The bearings permit vertical up and down motion of massage arm 54 in directions indicated by double arrowhead line 62 and rotational motion clockwise and counterclockwise in directions indicated by double arrowhead arc 64. The vertical position and rotational attitude of massage arm 54 are controlled by actuators (not shown), such as motors, responsive to signals received from computer 30, using methods known in the art.

Trolley 60 is supported between two transom spars 70 of a gantry 72 and is moved and positioned along transom spars 70 in directions indicated by double arrowhead line 74 by a motor (not shown) responsive to signals received from computer 30. Transom spars 70 are connected to upright support beams 76. Support beams 76 are mounted to a gantry base (not shown) and coupled to a motor (not shown) using methods known in the art so that the motor is controllable to move gantry 72 back and forth along massage table 24 in directions indicated by double arrow head line 78. The motor is controlled by control signals from computer 30.

There are numerous and varied methods known in the art for moving and determining the position of elbow joints 36, 52 and thumb 32 and finger 34 of each of robot massage hands 28. In FIG. 1, it is assumed, by way of example, that the motion of the elbow joints 36 and 52 and digits 32 and 34 (i.e. thumb 32 and finger 34) are controlled by actuators (not shown), such as motors, located in an actuator box 82 preferably mounted to upright beams 76. The actuators control the joints and digits via cables 80 that connect the actuators to the joints and digits. Massage arm 54 is preferably formed from a hollow tube and cables 80 are preferably ducted through massage arm 54 to reach the joints and digits. Similarly, cables 80 that are used to control digits 32 and 34 of robot massage hands 28 are preferably ducted through wrist tubes 42 to reach the digits. Computer 30 is preferably connected to actuator box 82 by a signal cable 84 and transmits signals to control the actuators that move and position the digits and elbow joints via signal cable 84.

By controlling the motion of digits 32 and 34, elbow joints 36 and 54 and actuators that move and rotate wrist tubes 42 and massage arm 54 and motors that move and position gantry 72 and massage arm trolley 60, computer 30 can position and operate massage hands 28 so as to massage substantially any part of the body of person 22. It should be noted that whereas a particular configuration of arm and wrist "appendages" and joints are shown in FIG. 1A for providing degrees of freedom of motion for robot massage hands 28, other configurations and joints known in the art are possible and can be advantageous. For example each wrist tube 42 can be connected to its own massage arm, and elbow joints, which enable bending motion about a single axis of rotation, can be replaced by joints, for example ball joints, that enable rotation about more than one axis. Wrist tubes 42 can also be coupled, for example, to a platform plate that enables wrist tubes 42 to move towards and away from each other. Other methods and devices for providing degrees of freedom of motion for robot massage hands 28 will occur to persons of the art. FIGS. 2A–2D schematically show robot massage hands 28 positioned and controlled by computer 30 to massage different parts of the body of person 22

Figure 2A:
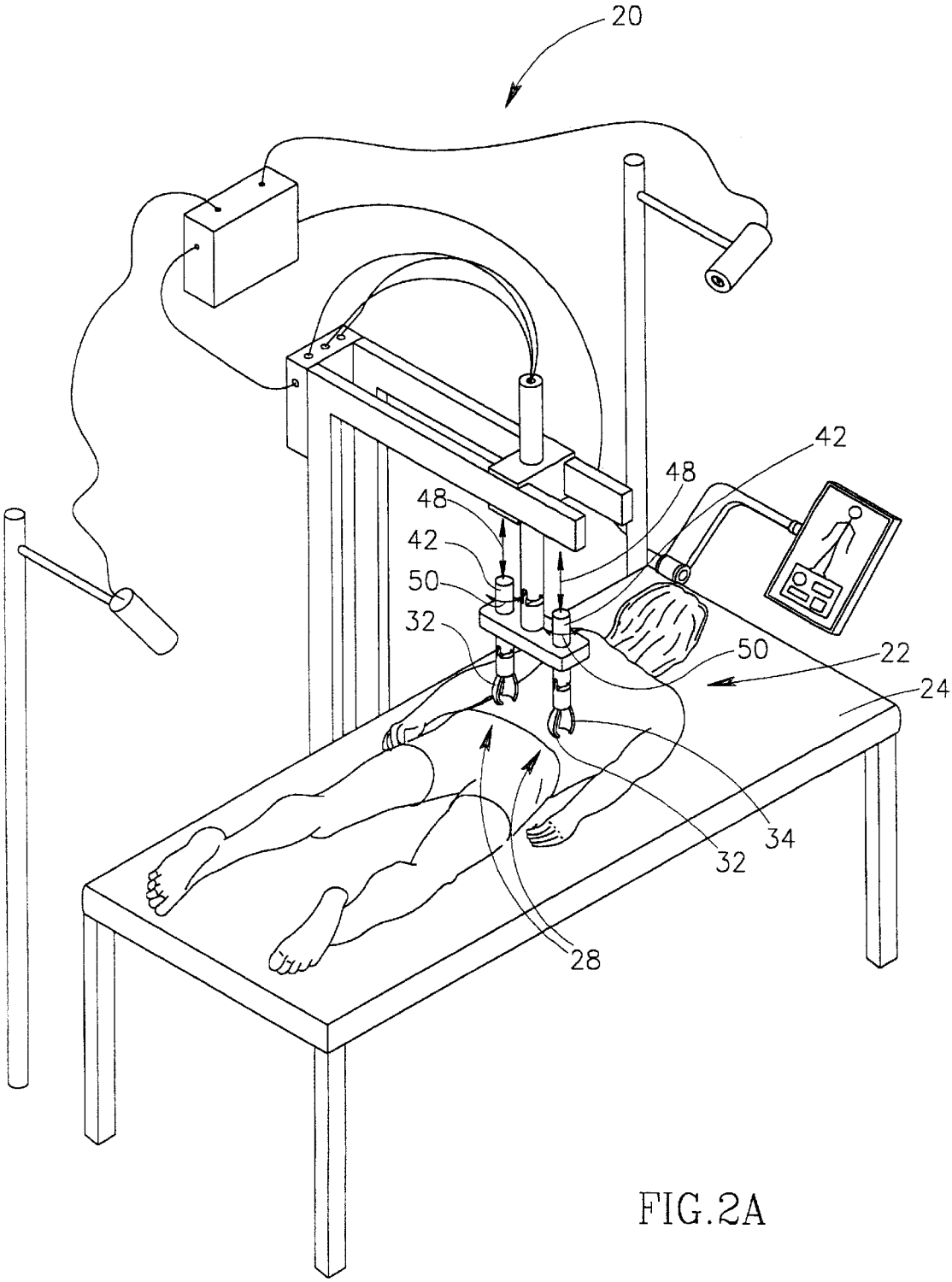
FIGS. 2A–2E schematically show the massage machine shown in FIG. 1A with the robot massage hands massaging different regions of the person's body, in accordance with a preferred embodiment of the present invention.

In FIG. 2A robot massage hands 28 are schematically shown massaging the small of the back of person 22. Wrist tubes 42 are moved up and down in directions indicated by double arrowhead lines 48 to alternately press one and then the other of robot massage hands 28 to the small of the person's back. When a massage hand 28 presses on the small of the back, wrist tube 42 of the massage hand is rotated back and forth in directions indicated by double arrowhead arc 50 to rotate thereby the massage hand. While robot massage hand 28 is being rotated, thumb 32 and finger 34 of the massage hand are repeatedly moved towards and away from each other to repeatedly squeeze and release muscles in the small of the back. The rotational and squeezing motions executed by robot massage hands 28 massage the small of the back with a kneading motion.

Figure 2B:
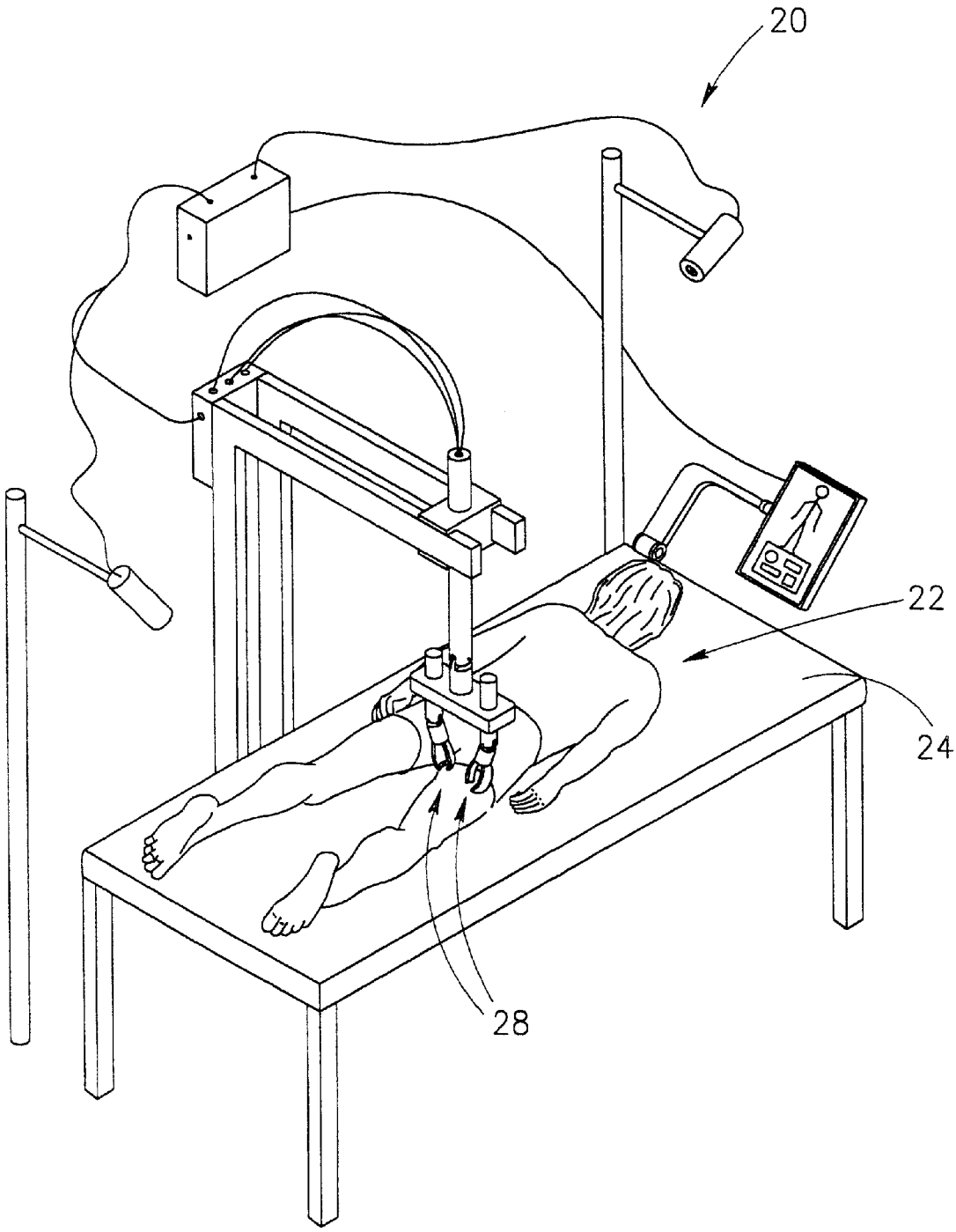
Figure 2C:
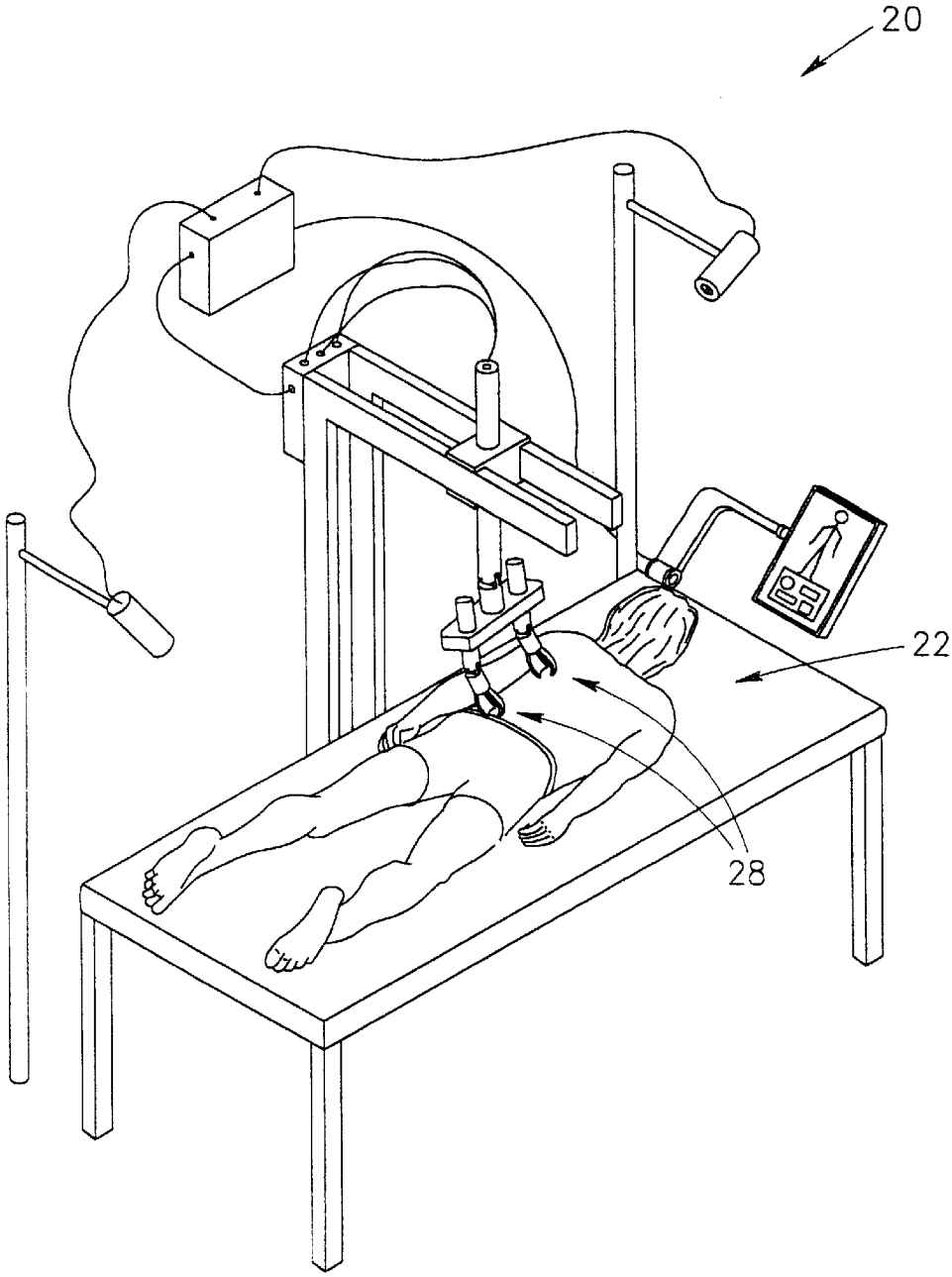

FIG. 2B shows robot massage hands 28 massaging the muscles of a leg of the person. In FIG. 2C robot massage hands 28 are schematically shown massaging a latissimus dorsi muscle of the person.

Figure 2D:
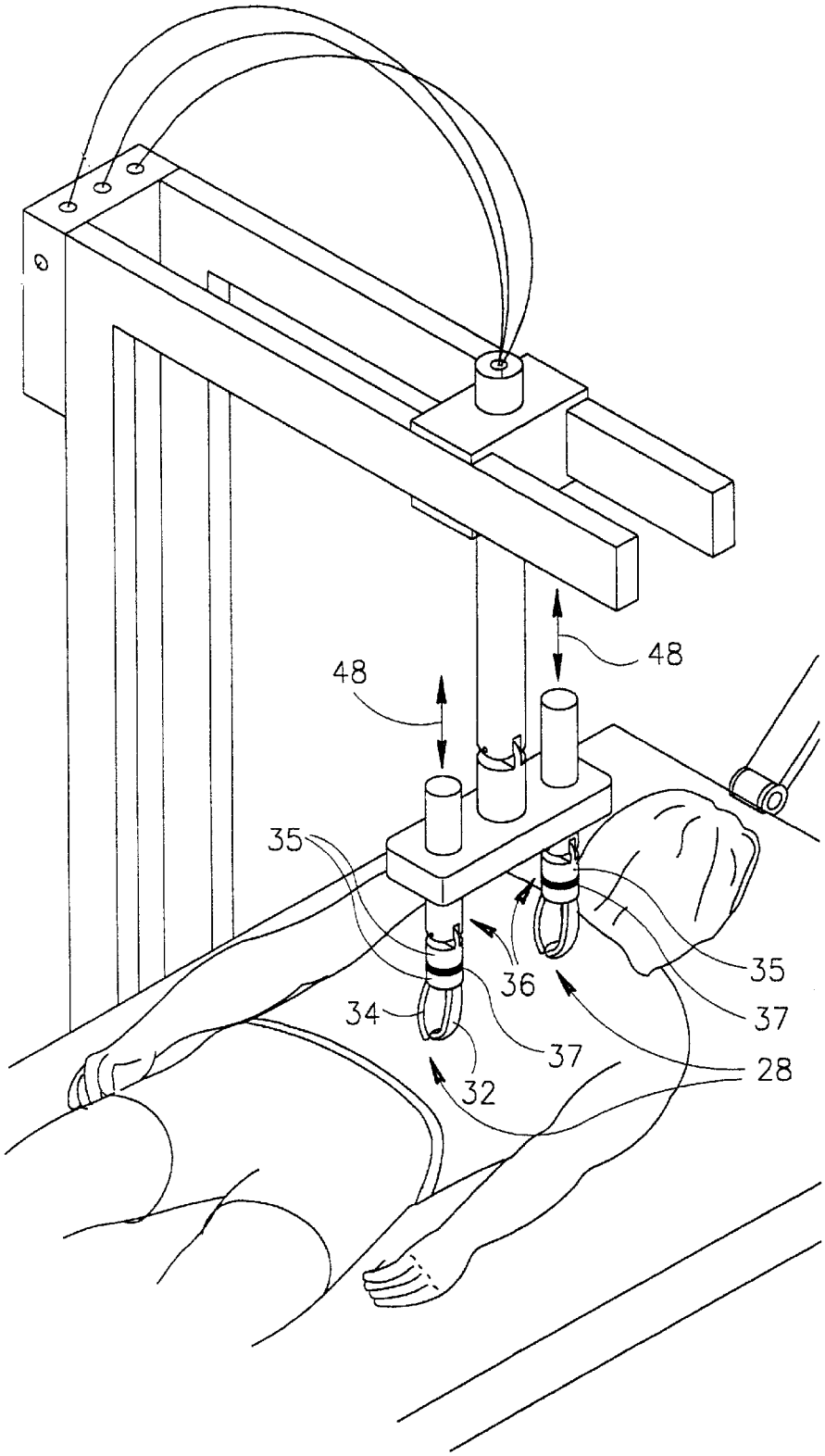

FIG. 2D schematically shows robot massage hands 28 massaging the back of person 22 with striking motions. FIG. 2D is magnified relative to other views showing robot massage hands 28 massaging person 22 to improve visibility of details of the robot hands. To perform the "striking massage" robot massage hands 28 are preferably moved cyclically rapidly up and down in directions indicated by double arrowhead lines 48 to, preferably, alternately strike the back of the person with a desired force. Preferably the robot massage hands are "closed" with thumb 32 "tucked" into finger 34. FIG. 2 schematically shows robot hands 28 at a point in the "striking massage" in which one of robot hands 28 is shown striking the person's back while the other is shown maximally displaced from the person's back.

Figure 2E:
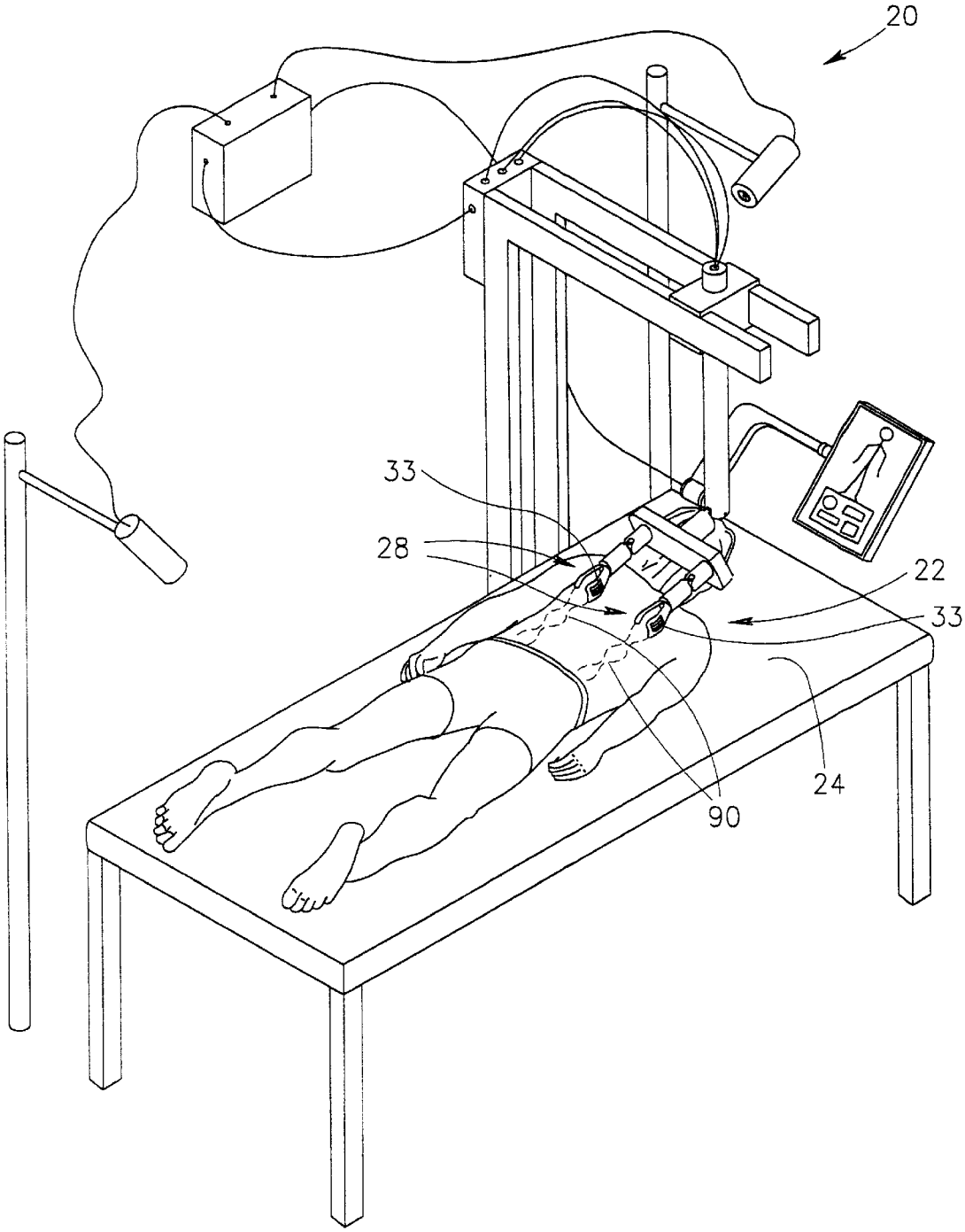

FIG. 2E shows robot massage hands 28 performing a caressing massage on the back of the person. During the caressing massage robot massage hands 28 are lightly pressed to the person's back and repetitively slowly drawn along his back while thumb 32 and finger 34 of each robot hand are cyclically moved towards and away from each other. The paths that the digits of each of robot massage hands 28 trace out on the person's back are shown by dashed lines 90.

In some preferred embodiments of the present invention, at least one digit of a robot massage hand comprises a relatively sharp protuberance or a relatively rough surface region. The sharp protuberance or rough surface region is pressed to a person's skin and moved to scratch the skin. By way of example, the backs of fingers 34 of robot hands 28 shown in FIG. 2E are formed with a rough surface region 33. To scratch the back of person 22 rather than caress his back as shown in FIG. 2E, one or both of rough surface regions 33 of fingers 28 is pressed to and drawn over his back.

Preferably, thumb 32 and finger 34 comprise force sensors, such as for example piezoelectric force sensors, that provide signals indicating a magnitude of force that thumb 32 and finger 34 exert on tissue that they squeeze. The signals are used by computer 30 to control the squeezing motion of the thumb and finger. Similarly, other force sensors are preferably disposed at various locations of massage head 26 and massage arm 54, using methods and devices known in the art, to generate signals responsive to forces other than squeezing forces that robot massage hands 28 exert on regions of a person's body during a massage. For example, preferably, force sensors are advantageously located to generate signals responsive to forces with which robot massage hands 28 press or twist muscles and tissue during a massage.

By way of example of such force sensors, referring to FIG. 2D, preferably, massage machine 20 comprises at least one force sensor that senses the force with which each robot hand 28 strikes the back of person 22 and generates an output signal responsive thereto. Preferably, the output signal is input to computer 30, which uses the signal to control the striking motion of the robot hand. Preferably, the at least one force sensor comprises a force sensor mounted in palm brace 36 of each robot massage hand 28. Preferably, palm brace 36 of each robot massage hand 28 is formed from two sections 35. Preferably, the force sensor comprises a piezoelectric disc 37 that is sandwiched between section 35. When the robot massage hand strikes the person's back, disk 37 generates a signal responsive to the force with which the robot massage hand strikes the person's back.

Preferably, massage machine 20 comprises a 3D imaging system that generates a 3D image of person 22. 3D imaging systems and cameras that provide substantially real time 3D imaging of a scene are commercially available and different 3D imaging methods and devices are known in the art. A 3D imaging camera is described in a home page of 3DV Systems Ltd. at URL "3dvsystems.com/zcam_fs" and in a home page of Genex Technologies Inc. at URL "genextech.com/prodo3", the disclosures of which are incorporated herein by reference.

Preferably, imaging data defining the 3D image of person 22 acquired by the imaging system is input from the imaging system to computer 30. The data is used during a massage of person 22 to control the position, orientation and motion of robot massage hands 28 relative to features of the person's body. Preferably, the imaging data is substantially real time data and if person 22 moves during a massage, the image of the person is updated. If the image data indicates person 22 has moved to such an extent as to prevent proper execution of the massage, computer 30 stops the massage until the person repositions himself properly.

In FIG. 1A, massage machine 20 is shown, by way of example, having a 3D imaging system for imaging person 22, comprising two 3D cameras 100 situated at opposite ends of massage table 24. In some preferred embodiments of the present invention, a single 3D camera having a large field of view is used to image person 22. The 3D camera is preferably placed over the center of massage table 24. Before massage machine 20 massages person 22, computer 30 controls the motor that moves gantry 72 to move the gantry to one end of massage table 24 so as not to obstruct the field of view of the 3D camera. The camera then images person 22 to provide computer 30 with initial 3D image data of the person that is used to control the positioning and motion of massage hands 28. During a massage, the 3D camera updates the image data using image data acquired with parts of transom spars 70 and massage head 26 obstructing the field of view of the camera.

In some preferred embodiments of the present invention a 3D camera is mounted to transom spars 70. At the beginning of a massage, computer 30 moves gantry 72 from one end of massage table 24 to the other to scan person 22 and provide initial image data of the person. The image data is thereafter updated using data from images of person 22 acquired by the 3D camera from partial views of the person as seen from the position of gantry 72 along massage table 24 and the location of the 3D camera on transom spars 70.

It should be noted that the use of 3D image data to control motion, positioning and orientation of robot massage hands 28 enables massage machine 20 to execute massages that would be difficult or substantially impractical without 3D imaging. For example, 3D imaging of person 22 provides image data that determine the position and slope of the sides the person's torso. This data enables computer 30 to position and orient robot massage hands 28 so that they can properly approach and massage the latissimus dorsi muscle as schematically shown in FIG. 2C.

Preferably, massage machine 20 comprises a video display screen 110, such as, preferably, a flat panel display, on which computer 30 generates an image 112 of person 22 responsive to imaging data that it receives from the 3D imaging system. Preferably, computer 30 also indicates the position of robot massage hands 28 on the video screen.

Preferably, computer 30 displays control buttons and icons 114 on video screen 110 that person 22 can press to input instructions to computer 30 specifying a type of massage that the person desires to receive. Preferably, person 22 can input data defining which regions of the person's body are to be massaged and in what sequence the regions are to be massaged, by sequentially pressing on corresponding regions of the image 112 on video screen 110. Some massage machines 20, in a preferred embodiment of the present invention, comprise a remote control unit such as, for example, an IR control unit similar to a TV control unit and data can be input to computer 30 without having to press video screen 110. Data is input to computer 30 by using the remote control unit to indicate user preferences.

Preferably, when a region of image 112 is pressed, computer 30 displays on video screen 110 a menu offering various options for defining a type of massage to be applied to the region and how long the massage is to be applied to the region. Preferably, computer 30 displays a menu of massage templates that define types of massages that person 22 can choose to be applied by robot massage hands 28 to the region that person 22 wants massaged. For example, one massage template might define a vigorous kneading massage comprising twisting and squeezing motions executed alternately by robot massage hands 28 on a region of a person's body, as schematically shown in FIG. 2A. Another massage template might define a sequence of rapid striking blows delivered by robot massage hands 28 to a region of a person's body. Yet another massage template might define a caressing massage in which robot massage hands 28 lightly press on a region of a person's body and execute figure eight motions. Other massage templates will readily occur to a person of the art.

Preferably, each massage template offers various options that person 22 can choose from to specify characteristics of the massage that the massage template defines. For example, preferably, once a person has chosen a massage template to be applied to a region of the person's body, the person can specify a range for magnitudes of forces applied by robot massage hands 28 to the region when the massage hands execute the massage defined by the template. Or the person might specify rapidity of motion of robot massage hands 28 during execution of the massage template. Other options relevant to different types of massage templates will occur to persons of the art.

By choosing from among the various templates and options preferably offered by computer 30 to a person using massage machine 20, the person can specify a massage "program" that the person wants applied to his or her body. For example, a person might choose to have his or her lower back vigorously massaged with a vigorous kneading massage applied with strong force for ten minutes. Following the lower back massage, the upper back might be massaged for five minutes with medium force striking blows. The person might choose to finish his or her massage with a caressing massage in which robot massage hands 28 are slowly drawn back and forth along the back. Preferably, during a massage the person can interrupt the massage program to change or modify the program. For example, on feeling a particular "sore spot", the person might choose to prolong the massage on the sore spot or decrease the force that robot massage hands 28 apply to the sore spot.

Preferably, video screen 110 is located on a panel 120 that can be moved and positioned so that the video screen 110 is easily accessible to a person whether lying on his or her back or stomach on massage table 24.

As shown in FIG. 1A, panel 120 is preferably mounted to an L shaped arm 122 so that panel 120 is rotatable about an axis 124 shown with a dashed line. Arm 122 is preferably mounted to massage table 24 and is preferably rotatable about an axis 126 shown with a dashed line. Video screen 110 is preferably connected to computer 30 by a signal cable 127 that threads through an interior recess of arm 122. In FIG. 1A panel 120 is positioned for use by a person lying on his or her stomach. In inset 128 arm 122 and panel 120 are rotated into a position suitable for use by a person lying on his or her back. When panel 120 is rotated to the position shown in inset 128, computer 30 reverses images it displays from top to bottom relative to images it displays when panel 120 is in the position shown in FIG. 1A in which person 22 is lying on his or her stomach.

Figure 3:
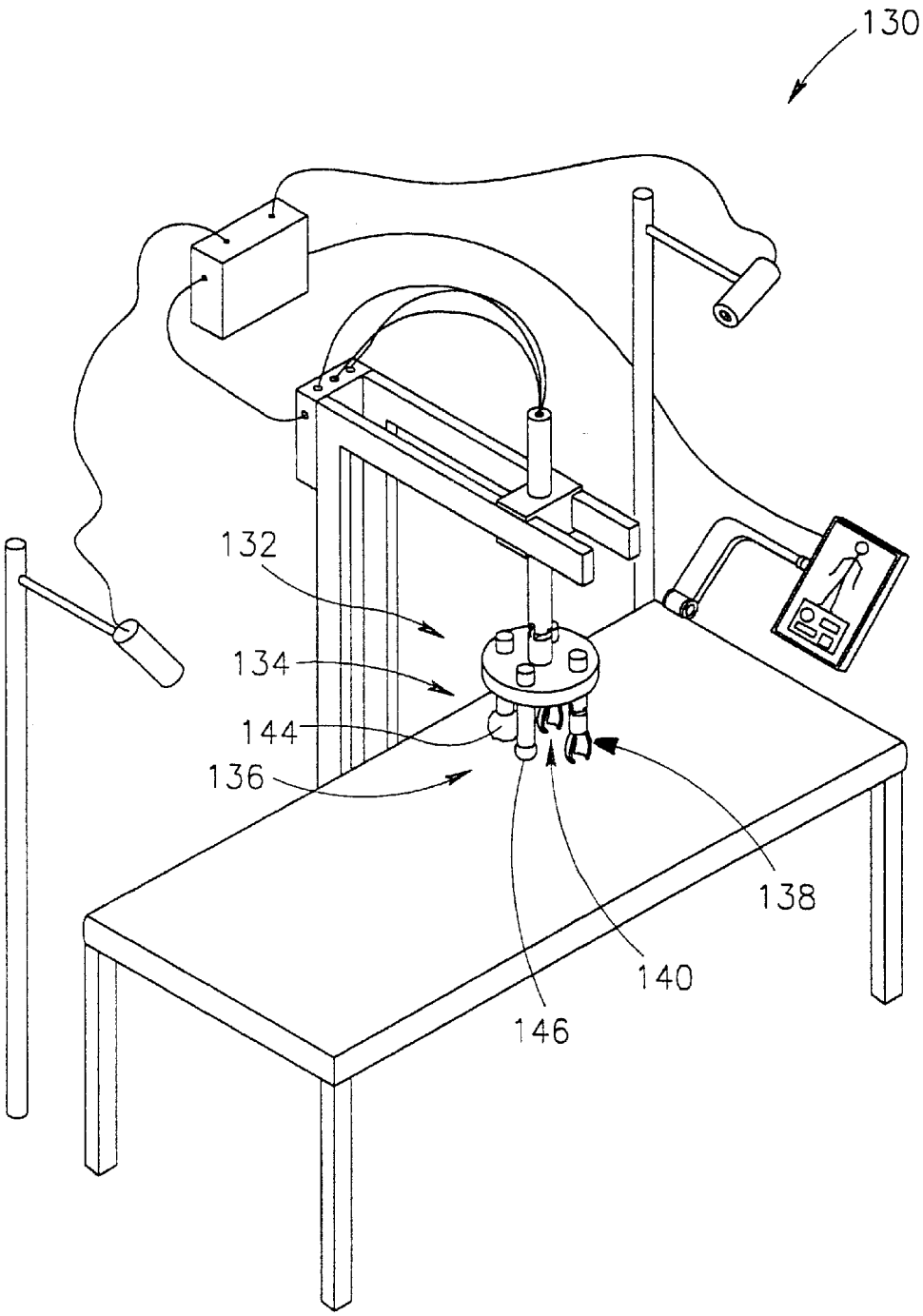
FIG. 3 shows a massage machine comprising four massage applicators, in accordance with a preferred embodiment of the present invention.

FIGS. 1–2E show a massage machine comprising a massage head having two massage applicators, which massage applicators are robot massage hands, in accordance with preferred embodiments of the present invention. A massage machine, in accordance with a preferred embodiment of the present invention, can comprise a number of massage applicators different from two and applicators that are not robot massage hands. FIG. 3 shows a massage machine 130 having a massage head 132 comprising, by way of example, four massage applicators 134, 136, 138 and 140, mounted at ends of wrist tubes 42. By way of example, massage applicators 134, 136, 138 and 140 are respectively, a soft cushion massager (massage applicator 134), a ball massager (massage applicator 136) and robot hand massagers (massage applicators 138 and 140). Soft cushion massager 134 comprises a relatively large soft cushion 144. Motion of wrist tube 42 is controlled to repeatedly press cushion 144 to a region of a person's body to be massaged and preferably controlled to move cushion 144 with various massaging motions, such as for example oscillatory rotary motion, to massage the region. Similarly, ball massager 136 comprises a relatively hard ball 146, such as a wooden ball, that is used to massage a person's body. During a massage of a person, applicators that are not being used to massage a region of the person's body are "retracted" by controlling their respective wrist tubes to raise the applicators away from the region. Soft cushion massager 134 and ball massager 136 and robot hand massagers 138 and 140 are positioned and moved to massage a person by a computer 30 using methods similar to methods used to control and move robot hand massagers 28 described above.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of preferred embodiments thereof that are provided by way of example and are not intended to limit the scope of the invention. The described preferred embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. A massage machine for massaging a person's body comprising:

at least one massage applicator shaped to be pressed on a region of a person's body to massage the region;

at least one first actuator for controlling motion of the at least one applicator;

a support structure to which the at least one massage applicator is mounted moveable to position and orient the at least one applicator to massage different regions of the person's body;

at least one second actuator that moves the support structure;

a 3D vision system that generates data responsive to features of the person's body and positions of the features; and a computer that receives the data and controls the at least one first actuator and the at least one second actuator responsive to the 3D vision data to selectively control each of the applicators so as to massage at least one region of the person's body with at least one type massage motion.

2. A massage machine according to claim 1 wherein the at least one massage applicator comprises a plurality of applicators.

3. A massage machine according to claim 2 wherein a massage applicator of the plurality of applicators has a shape of a ball.

4. A massage machine according to claim 3 wherein the ball is a relatively hard.

5. A massage machine according to claim 3 wherein the ball is a relatively soft.

6. A massage machine according to claim 2 wherein a massage applicator of the plurality of applicators is a soft cushion.

7. A massage machine according to claim 2 wherein a massage applicator of the plurality of applicators is a robot hand having a first digit and at least one second digit that is opposable to the first digit, wherein the first digit and at least one second digit are moveable towards and away from each other.

8. A massage machine according to claim 2 wherein the computer is programmable to control actuators of the massage machine to massage the person's body responsive to a desired program.

9. A massage machine according to claim 8 wherein the program defines a sequence of desired regions of the person's body to be massaged.

10. A massage machine according to claim 9 wherein the program defines desired massage motions to be applied to each of the desired regions of the person's body.

11. A massage machine according to claim 10 wherein the program defines the duration of each of the desired massage motions.

12. A massage machine according to claim 10 wherein the program defines which of the applicators is used to provide the desired massage motions.

13. A massage machine according to claim 8 wherein the program is modifiable while the computer is executing the program.

14. A massage machine for massaging a person's body comprising:

at least one robot hand comprising a first digit and at least one second digit wherein the first digit is opposable to each of the at least one second digit, which first and at least one second digit are moveable to simulate at least one massage motion of the human hand;

at least one digit actuator that moves the first and at least one second digit;

a support structure to which the at least one robot hand is mounted moveable to position and orient the at least one robot hand to massage different regions of the person's body;

at least one motion actuator that moves the support structure;

a 3D vision system that generates data responsive to features of the person's body and positions of the features; and a computer that receives the data and controls at least one of the at least one digit actuator and at least one motion actuator of a robot hand of the at least one robot hand responsive to the 3D vision data to massage at least one region of the person's body with at least one type massage motion that mimics a massage motion performed by a person.

15. A massage machine according to claim 14 wherein the at least one type of massage motion comprises a squeezing motion in which the first digit and at least one second digit of the robot hand move towards each other to squeeze the region of the person's body with a desired force.

16. A massage machine according to claim 14 wherein the at least one type of massage motion comprises a pressing motion in which at least one digit of the robot hand presses a region of the person's body with a desired force of desired magnitude.

17. A massage machine according to claim 14 wherein the at least one type of massage motion comprises a kneading motion in which the first digit and at least one second digit of the robot hand press the region of the person's body with a first desired force and squeeze the region with a second desired force while the robot hand executes a circular motion that applies a desired torque to the region.

18. A massage machine according to claim 14 wherein the at least one type of massage motion comprises a striking motion in which at least one digit of the robot hand strikes the region with a desired force.

19. A massage machine according to claim 14 wherein the at least one type of massage motion comprises a caressing motion in which at least one digit of the robot hand presses the region lightly and moves along the region with a stroking motion.

20. A massage machine according to claim 14 wherein at least one digit of the robot hand comprises a relatively sharp protuberance.

21. A massage machine according to claim 20 wherein the at least one massage motion comprises a scratching motion in which the relatively sharp protuberance of a digit of the robot hand that comprises a sharp protuberance presses against the region and the protuberance moves to scratch the region.

22. A massage machine according to claim 14 wherein the computer is programmable to control actuators of the massage machine to massage the person's body responsive to a desired program.

23. A massage machine according to claim 22 wherein the program defines a sequence of desired regions of the person's body to be massaged.

24. A massage machine according to claim 22 wherein the program defines desired massage motions to be applied to each of the desired massage regions of the person's body.

25. A massage machine according to claim 24 wherein the program defines the duration of each of the desired massage motions.

26. A massage machine according to claim 22 wherein the program is modifiable while the computer is executing the program.

27. A massage machine according to claim 14 and comprising at least one massage applicator other than the at least one robot hand mounted to the support structure.

28. A massage machine according to claim 14 and comprising at least one sensor that generates digit force signals responsive to a force with which the first digit and at least one second digit move toward each other.

29. A massage machine according to claim 28 wherein the computer receives the digit force signals and controls the force with which the first digit and at least one second digit move toward each other responsive thereto.

30. A massage machine according to claim 14 wherein the at least one robot hand comprises at least one haptic sensor that generates signals responsive to the at least one robot hand touching the person's body.

31. A massage machine according to claim 30 wherein the computer receives the signals generated by the at least one haptic sensor and controls at least one actuator of the massage machine responsive thereto.

* * * * *